US009585436B2

(12) United States Patent
Sketch et al.

(10) Patent No.: US 9,585,436 B2
(45) Date of Patent: Mar. 7, 2017

(54) INSERT DEVICE FOR A SHOE

(71) Applicants: Mary Jo Sketch, Lincoln City, OR (US); Anne Marie Sketch, Lincoln City, OR (US)

(72) Inventors: Mary Jo Sketch, Lincoln City, OR (US); Anne Marie Sketch, Lincoln City, OR (US)

( * ) Notice: Subject to any disclaimer, the term of this patent is extended or adjusted under 35 U.S.C. 154(b) by 0 days.

(21) Appl. No.: 14/272,390

(22) Filed: May 7, 2014

(65) Prior Publication Data

US 2014/0338224 A1 Nov. 20, 2014

Related U.S. Application Data

(60) Provisional application No. 61/823,488, filed on May 15, 2013.

(51) Int. Cl.
*A43B 19/00* (2006.01)
*A43B 23/28* (2006.01)

(52) U.S. Cl.
CPC ..... *A43B 23/28* (2013.01)

(58) Field of Classification Search
CPC ..... A43B 23/28
USPC ..... 36/58.6, 69
See application file for complete search history.

(56) References Cited

U.S. PATENT DOCUMENTS 1,086,673 A * 2/1914 Koppe ..... 36/58.5
1,392,628 A * 10/1921 Drechsler ..... 36/58.5
1,696,129 A * 12/1928 Silver ..... 12/146 R
1,736,245 A * 11/1929 Basar, Jr. ..... 36/55
1,895,141 A * 1/1933 Watanabe ..... 36/55
2,275,191 A * 3/1942 Schwartz et al. ..... 36/58.5
2,325,004 A * 7/1943 Brauer ..... 36/80
3,548,420 A * 12/1970 Spence ..... 623/37
3,977,098 A * 8/1976 Chalmers ..... 36/89
4,642,916 A * 2/1987 Collins ..... 36/58.6
4,896,440 A * 1/1990 Salaverria ..... A43B 3/102 12/142 RS
5,632,057 A * 5/1997 Lyden ..... A43B 3/0063 12/146 B
5,842,292 A * 12/1998 Siesel ..... 36/58.5
6,270,872 B1 * 8/2001 Cline et al. ..... 428/40.1
6,362,387 B1 * 3/2002 Carlson et al. ..... 602/41
(Continued)

OTHER PUBLICATIONS www.footpetals.com, "Heavenly Heels" product advertisement from web page printed on May 6, 2014.
(Continued)

*Primary Examiner* — Jila M Mohandesi
*Assistant Examiner* — Katharine Gracz
(74) *Attorney, Agent, or Firm* — Mohr Intellectual Property Law Solutions, PC

(57) ABSTRACT

A shoe liner adapted to selectively couple to a vertical, rear, interior wall of a shoe includes a natural fabric body that is an elongated ovoid shape having a foot side and an opposite shoe side. The shoe side includes an adhesive back adapted to selectively adhere to the vertical backwall interior side of the shoe. The shoe liner further includes an interior chamber defined between the foot side and shoe side layers. The interior chamber is adapted to hold a volume of cotton batting filler material. The exterior surfaces of the shoe liner are made from a natural material and are available in a myriad of colors, textures, and patterns.

13 Claims, 3 Drawing Sheets

(56) References Cited

U.S. PATENT DOCUMENTS

| | | | | |
|---|---|---|---|---|
| 6,399,918 | B1 * | 6/2002 | Komine | B29C 43/006 100/295 |
| 8,424,117 | B2 * | 4/2013 | Hasan et al. | 2/239 |
| 2003/0198804 | A1 * | 10/2003 | Wendland | C09J 7/041 428/343 |
| 2004/0049944 | A1 * | 3/2004 | Lee | 36/9 R |
| 2004/0205982 | A1 * | 10/2004 | Challe | A43B 9/02 36/55 |
| 2007/0142758 | A1 * | 6/2007 | Elsner | A61F 13/04 602/8 |
| 2008/0229612 | A1 * | 9/2008 | Sommer | A43B 1/0045 36/44 |
| 2009/0320181 | A1 * | 12/2009 | MacGregor, Jr. | 2/231 |
| 2010/0212069 | A1 * | 8/2010 | Williams et al. | 2/244 |
| 2013/0055592 | A1 | 3/2013 | Elsenbach | |

OTHER PUBLICATIONS

Dr. School's brand Dream Walk Sole Expressions brand heel liners from www.drscholls.com printed on May 6, 2014.

* cited by examiner

INSERT DEVICE FOR A SHOE

PRIORITY CLAIM

The present application claims benefit under 35 USC Section 119(e) of U.S. Provisional Patent Application Ser. No. 61/823,488 filed on May 15, 2013 by the common inventors named above. The present application is based on and claims priority from this application, the disclosure of which is hereby expressly incorporated herein by reference for all purposes.

FIELD OF THE INVENTION

The present invention relates to systems, methods, and devices adapted for use inside a shoe and more specifically for an insert to be placed on an interior, vertical back wall (heel) of the shoe to provide increased comfort to the wearer of the shoe.

BACKGROUND

There are some known insert devices for shoes. Most known devices are designed to be used underneath the foot, placed inside the shoe, on top of the sole of the shoe and are used to pad or absorb shock, or to absorb odors, or both. One representative reference of this type of shoe insert is U.S. Published Pat. App. No. 2013/0055592 to Elsenbach published on Mar. 7, 2013.

Another type of shoe insert, known as heel liners, are presently available for sale by the Dr. Scholl's Company of Memphis Tenn. under the brand name of "Sole Expressions Heel Liners". Another product is distributed by ETC Group, Inc. of New York, N.Y. under the brand of "feet treats". And yet another is branded as "Heavenly Healz" and is sold by Footpetals.com.

However, known shoe inserts have some inherent limitations including that they do not absorb perspiration, are not environmentally friendly to produce or dispose of, are not economical to produce, and are not comfortable. Therefore, there remains a need for a system, device, and method that provides increased comfort, is more economical to produce, and are more environmentally friendly both to produce and to dispose.

DRAWING

DESCRIPTION OF THE INVENTION

Possible embodiments will now be described with reference to the drawings and those skilled in the art will understand that alternative configurations and combinations of components may be substituted without subtracting from the invention. Also, in some figures certain components are omitted to more clearly illustrate the invention.

Figure 1:
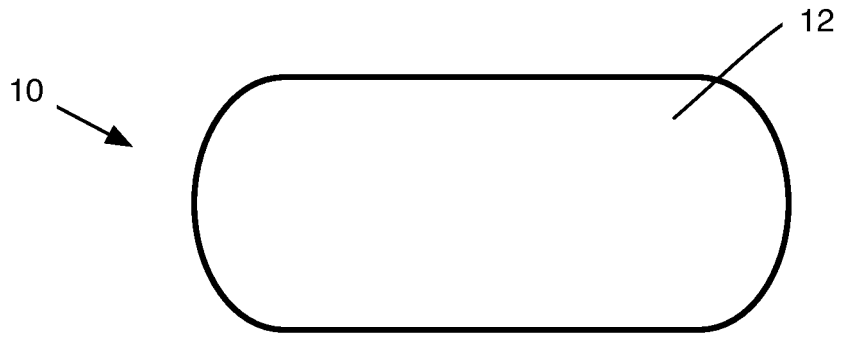
FIG. 1 is a front view of a shoe liner according to one preferred embodiment of the present invention.
Figure 2:
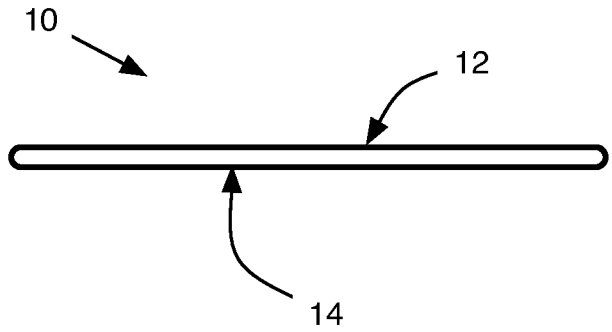
FIG. 2 is a top view of the shoe liner of FIG. 1.
Figure 3:
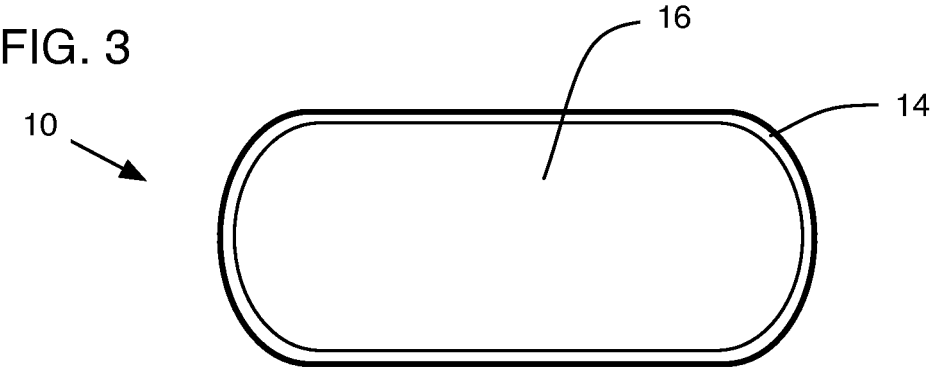
FIG. 3 is a back view of the shoe liner of FIG. 1.
Figure 4:
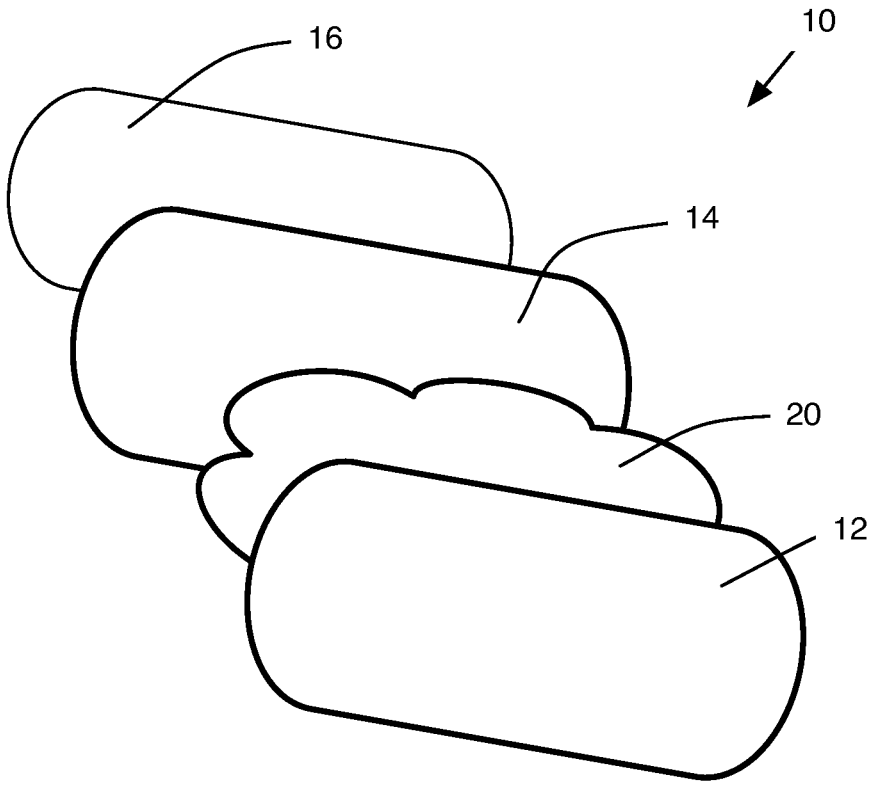
FIG. 4 is an exploded front view of the shoe liner of FIG. 1.
Figure 5:
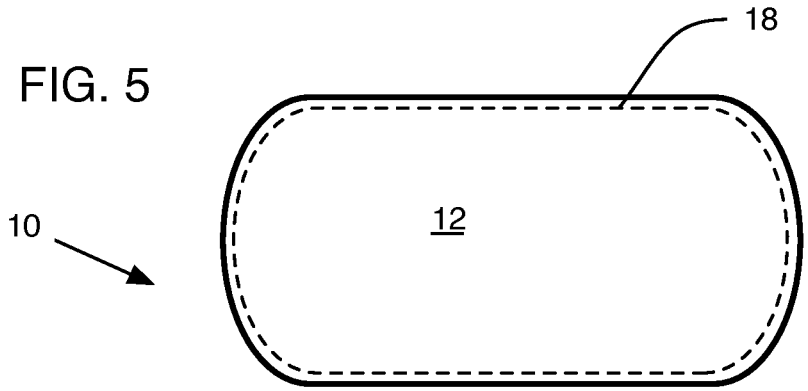
FIG. 5 is an alternate front view of the shoe liner of FIG. 1.
Figure 6:
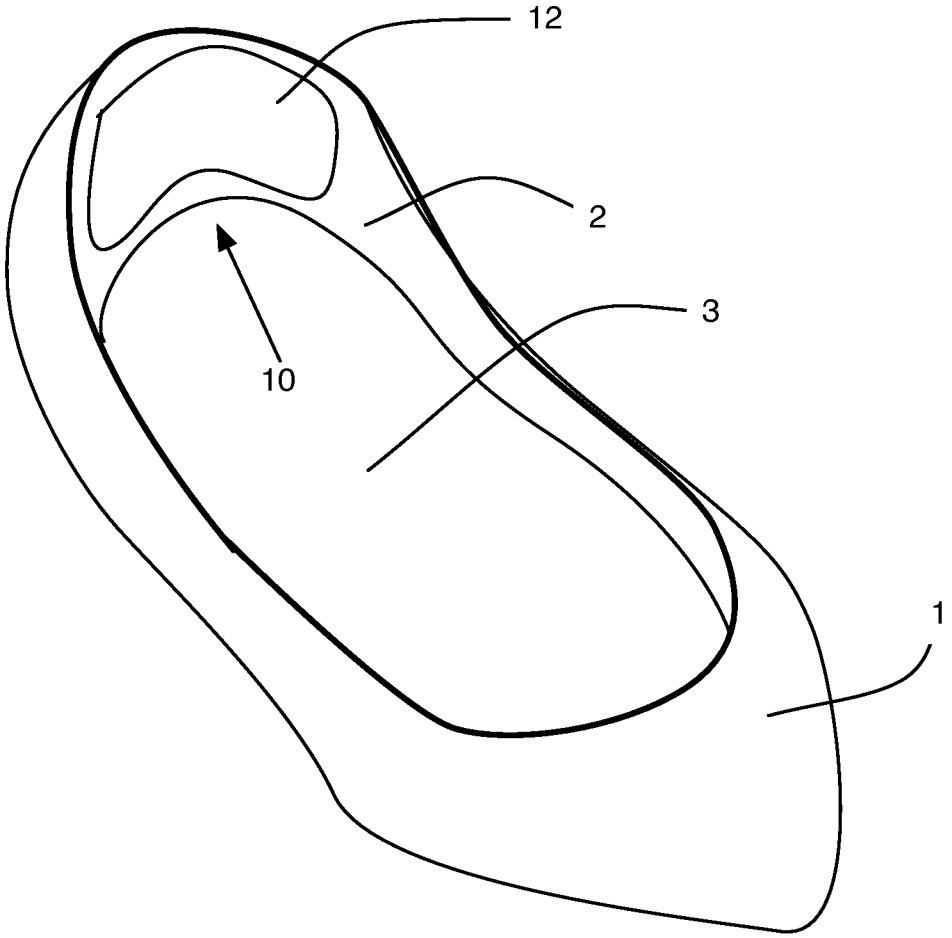
FIG. 6 is an offset frontal view showing an environment and method of use for the shoe liner of FIG. 1.

In one preferred embodiment of the present invention, as FIGS. 1-6 illustrate, a shoe liner 10 adapted to selectively couple to a vertical rear wall 2 of a shoe 1 includes a natural fabric body that is an elongated ovoid shape having a foot side 12 and an opposite shoe side 14. The shoe side includes an adhesive back 16 adapted to selectively adhere to the vertical backwall interior side of the shoe provided by the wearer. The shoe liner further includes an interior chamber. The interior chamber is adapted to hold a volume of cotton batting filler material 20. The exterior surfaces of the shoe liner are made from a natural material and are available in a myriad of colors, textures, and patterns.

The shoe liner consists of a front or foot side 12 coupled by threaded stitches 18 to a shoe or backside 14 to form an interior chamber. The interior chamber is adapted to receive a selected amount of cotton batting material 20. The shoe side 14 further includes an adhesive material such as carpet tape that is activated by a hot iron to affix to the backside of the shoe liner 10. The carpet tape further includes a protective layer that is removable to expose a self-adhesive layer. This allows the wearer of the shoe to place the shoe liner on the back wall 2 of the shoe. This back wall 2 of the shoe is not the sole 3 of the shoe.

A method of use of the shoe liner 10 includes making the shoe liner out of a natural material such as a cotton fabric, using cotton batting (another natural material) as the filler material, and using traditional thread to mechanically couple (sew or stitch) the front and back portions together. Then an adhesive layer is affixed to the back of the shoe liner. And then the shoe liner is adhered to the back, interior wall of a shoe.

Contemplated suitable materials for the present invention include, preferably, natural materials including cotton fabric, canvas, hemp, bamboo, silk, and blends of these natural fabrics for the first and second layer. Additional fabrics may also be used including man-made, synthetic materials, blends of synthetics with natural materials, and the like. The batting material is, ideally, cotton batting. However, other batting materials could work as well including polyester and other synthetics as well as blends of synthetics and natural fibers. Hypoallergenic materials may also be substituted for any of the preferred materials.

In one particular preferred embodiment a means for mechanically coupling various components together, such as the first layer to the second layer, comprises cotton thread. In another contemplated preferred embodiment the means for mechanically coupling various components together, such as the first layer to the second layer, comprises polyester thread.

A preferred embodiment includes batting comprising polyester. Another preferred embodiment includes batting comprising cotton. And, additional embodiments include the use of recycled materials for the batting, the first layer, and the second layer, for example.

Certain woven and knit fabrics are well suited to various preferred embodiments of the present invention. This includes woven and knit fabrics having from about 100 to about 144 thread count. Further, either combed or uncombed fibers will also work as will balanced plain weave fabrics. Certain natural cellulosic fibers including cotton (seed hair), flax, ramie, hemp, bamboo (bast), and silk are particularly well-suited for various preferred embodiments of the present invention.

In other contemplated embodiments, certain manufactured fibers would also work well including regenerated cellulose-Rayon and Lyocell. Other synthetics including polyester and nylon would also work well.

Depending on the material selected to create any of the preferred embodiments of the present invention, certain combinations will provide more desirable results. For example, for woven fabrics, a balanced plain weave will provide preferred results. For knit fabrics, a rib knit or interlock will provide desirable results.

In various preferred embodiments certain dying and printing methods are suitable for the selected fabric of the product and may be used depending on the selected fabric used in the finished good including piece dyed, fiber dyed, yarn dyed, blotch printing, overprint, and screen printing, for example. Further, the following yarns may be used in the fabrics chosen for the product including simple spun and filament.

However, in other contemplated embodiments, other fabrics will also work including, for example for woven fabrics, the following weaves including unbalanced plain weave or twill will work well. And for knits, jacquared double knit, brushed tricot, or warp knit would also work.

Additional contemplated fabrics include broadcloth, batiste, challis, calico, peachskin, percale, lawn, oxford cloth, chino, flannette, and flannel, for example. However, other combinations and materials could work and their omission from the above description should not be construed as being excluded from the scope, spirit, and intention of the present invention.

Another contemplated use of the present invention includes placing the device on the inside bottom of the shoe to help with preventing the foot from slipping inside the shoe, as might occur when a user is wearing high heels.

One well-suited adhesive contemplated for the present invention includes a double sided fiberglass carpet tape.

Although the invention has been particularly shown and described with reference to certain embodiments, it will be understood by those skilled in the art that various changes in form and detail may be made without departing from the spirit and scope of the invention. We claim:

We claim:

1. A shoe liner permanently coupled to an interior rear sidewall of a shoe, the rear sidewall disposed so that the shoe liner is adjacent to the heel of the user's foot, and the shoe liner consisting of:

a body having a first layer, a second layer, a layer of cotton batting filler material, and an adhesive layer;

wherein:

the first layer comprises a foot side and a first internal side and a second layer comprises a shoe side and a second internal side, the first internal side of the first layer and the second internal side of the second layer configure to define an interior chamber between the first layer and the second layer, the first and second layer are configured to be an elongated ovoid shape, the elongated ovoid shape of each consisting of two substantially straight parallel sides separating two substantially curved ends, the first layer and the second layer are secured together with polyester thread stitches disposed around the perimeter of the shoe liner, the adhesive layer is a double-sided adhesive tape with fiberglass that is permanently attached by heat to the shoe side of the second layer and the interior rear sidewall of the shoe; and the layer of cotton batting filler material arranges in the interior chamber.

2. The shoe liner of claim 1 wherein:

the first and second layer comprises a natural material.

3. The shoe liner of claim 2 wherein the natural material comprises any combination of materials selected from the set comprising cotton, hemp, or bamboo.

4. A method of making a shoe liner adhered to an interior rear wall of a shoe, the method comprising:

shaping a first layer of natural material arranged in an elongated ovoid shape, the elongated ovoid shape consisting of two substantially straight parallel sides separating two substantially curved ends;

shaping a second layer of natural material to configure an elongated ovoid shape, the elongated ovoid shape consisting of two substantially straight parallel sides separating two substantially curved ends;

disposing a filler layer cotton batting between the first and second layer;

coupling the first and second layer together with polyester thread stitches to encapsulate the filler layer;

coupling an adhesive backing comprised of double-sided adhesive tape with fiberglass to the second layer and the interior rear wall of the shoe using a hot iron to permanently bond the adhesive backing to the second layer and the interior rear wall.

5. The method of claim 4 wherein:

the first layer natural material includes any material from the set comprising cotton, hemp, bamboo, and combinations and blends of cotton, hemp, and bamboo; and the second layer natural material includes any material from the set comprising cotton, hemp, bamboo, and combination and blends of cotton, hemp, and bamboo.

6. A shoe liner permanently adhered to a rear inner wall of a shoe, the rear inner wall disposed so as to be proximate to a user's heel when the user wears the shoe and placing the shoe liner in contact with the user's heel, the shoe liner consisting of:

a first layer, a second layer, a layer of odor absorbing filler material, and a fiberglass-reinforced adhesive layer;

wherein the first layer and the second layer each comprise a natural material and further arrange to define an interior chamber between the first layer and the second layer; the first and second layer are configured to be an elongated ovoid shape consisting of two substantially straight parallel sides separating two substantially curved ends, and the first layer is coupled to the second layer;

the adhesive layer permanently couples the shoe liner to the rear inner wall by attaching from the rear inner wall to the second layer on a side opposite from the first layer; and the layer of filler material is disposed in the interior chamber.

7. The shoe liner of claim 1 wherein the first and second layer are comprised of fabric that has a thread count from 100 to 144.

8. The shoe liner of claim 6 wherein the first and second layer are comprised of fabric that has a thread count from 100 to 144.

9. The shoe liner of claim 6 wherein at least the first layer is selected from the set comprising fabrics made from cotton, hemp, bamboo, and combinations and blends of cotton, hemp, and bamboo.

10. The shoe liner of claim 6 wherein the filler material is made from a hypoallergenic material.

11. The shoe liner of claim 6 wherein the first layer is coupled to the second layer with polyester thread stitches.

12. The shoe liner of claim 11 wherein the first and second layer are comprised of fabric that has a thread count from 100 to 144.

13. The shoe liner of claim 12 wherein the filler material is made from a hypoallergenic material.

* * * * *